US006767244B2

(12) United States Patent
Saito

(10) Patent No.: US 6,767,244 B2
(45) Date of Patent: Jul. 27, 2004

(54) CONNECTOR CONSTRUCTION AND A METHOD FOR CONNECTING A PAIR OF CONNECTORS

(75) Inventor: Masashi Saito, Yokkaichi (JP)

(73) Assignee: Sumitomo Wiring Systems, Ltd., Yokkaichi ( * ) Notice: Subject to any disclaimer, the term of this patent is extended or adjusted under 35 U.S.C. 154(b) by 0 days.

(21) Appl. No.: 10/319,358

(22) Filed: Dec. 13, 2002

(65) Prior Publication Data

US 2003/0114038 A1 Jun. 19, 2003

(30) Foreign Application Priority Data

Dec. 14, 2001 (JP) ..... 2001-381636

(51) Int. Cl.[7] ..... H01R 13/60

(52) U.S. Cl. ..... 439/532; 439/716; 439/248

(58) Field of Search ..... 439/532, 716, 439/247, 248, 540; 248/221, 225.11, 235, 243, 221.11

(56) References Cited

U.S. PATENT DOCUMENTS 6,155,857 A * 12/2000 Kato et al. ..... 439/248
6,378,825 B1 * 4/2002 Yee et al. ..... 248/221.11

FOREIGN PATENT DOCUMENTS

JP 10-172656 6/1998

* cited by examiner

*Primary Examiner*—Alex Gilman
(74) *Attorney, Agent, or Firm*—Anthony J. Casella; Gerald E. Hespos

(57) ABSTRACT

Female and male connectors (10, 20) are provided on body and trim panels (1, 5), respectively. A supporting plate (35) is raised from the trim panel (5), and a loose hole (36) is formed in the supporting plate (35). A leg (31) projects from a bottom end of the male connector (20) and a fastening plate (32) is at the leading end of the leg (31). The leg (31) is inserted into the loose hole (36) and the fastening plate (32) engages surface areas adjacent the loose hole (36). A guiding receptacle (50) is provided on the bottom surface of a holder (11) of the female connector (10). The leg (31) moves in the loose hole (36) of the supporting plate (35) during connection to correct displacement.

13 Claims, 11 Drawing Sheets

CONNECTOR CONSTRUCTION AND A METHOD FOR CONNECTING A PAIR OF CONNECTORS

BACKGROUND OF THE INVENTION

1. Field of the Invention

The invention relates to a construction for connecting connectors on two plates as the plates are mounted together.

2. Description of the Related Art

A known construction includes a waiting-side connector mounted, for example, on a body panel and connected with a power-supply side wiring harness. The known construction also includes a movable connector mounted, on a trim panel and connected with an electrical or electronic device. The moveable connector is connectable with the waiting-side connector as the trim panel is mounted on the body panel.

The body panel and the trim panel are both large parts. Additionally, the connectors may not have good mounting precision and may be displaced from each other. Thus, the movable connector typically is mounted for vertical and horizontal displacement and has a spring piece on its outer periphery to take up a displacement of the two connectors. Such an assembly is disclosed, for example, in Japanese Unexamined Patent Publication No. 10-172656.

The invention was developed for above environment to enlarge a range of displacement of connectors during connection.

SUMMARY OF THE INVENTION

The invention is directed to a construction for connecting first and second connectors. The first connector may be on a first member and the second connector on a second member. The construction enables the first and second connectors to be connected with each other as the first and second members are mounted on one another. The second member may comprise a supporting plate for contacting the second connector. The supporting plate is formed with a loose hole and the second connector is formed with a leg insertable into the loose hole while defining a clearance to the loose hole. A fastening portion is provided at the leading end of the leg for sandwiching the supporting plate between the fastening portion and portions of the second connector adjacent the base end of the leg. At least one slanted guide may be at an engaging end of the second connector for positioning the connectors.

The clearance of the leg in the loose hole accommodates displacement, and there is no limit in the dimension of the clearance. Thus, the displacement can be taken up over a wide range. Further, unlike the prior art, a spring piece is not needed, and a smaller force is required to connect the connectors since no returning resilient force is exerted during positioning.

The second connector is connected with the first connector as the second member is mounted on the first member. The two connectors may be offset or rotationally displaced during this connection. However, the slanted guide of the second connector guides the connectors and moves the leg in the loose hole of the supporting plate to correct offsets and angular displacements. Thus, the two connectors are connected efficiently.

The supporting plate preferably has an insertion groove that extends from the loose hole to an outer edge of the supporting plate to permit insertion of the leg in a direction substantially parallel with the supporting plate. Thus, the leg can be introduced into the loose hole even if the fastening portion is formed integrally or unitarily with the leg and the construction can be simplified.

Insertion of the leg into the insertion groove preferably is guided by a projection on a surface of the supporting plate facing either the second connector or the fastening portion.

Spaced apart restricting ribs may be formed on a surface of the supporting plate facing either the second connector or the fastening portion, and a contact rib is formed on the second connector or the fastening portion The contact rib is between the restricting ribs and contacts the restricting ribs to restrict angular rotation of the connector. Thus, the movable range of the connector is not unnecessarily large during rotational displacement.

The second connector preferably is provided with at least one guide rib to be introduced into a corresponding guide groove on the first connector.

At least one shake-preventing rib is provided on either one of surfaces of the supporting plate facing the second connector or the fastening portion.

The invention also relates to a method for connecting connectors. The method comprises providing a first connector on a fixed member and a second connector on a mountable member. The method then comprises providing a supporting plate with a loose hole. The second connector is formed with a leg insertable into the loose hole while defining a clearance to the loose hole, and a fastening portion is provided at the leading end of the leg for tightly holding the supporting plate in cooperation with the second connector.

The method may further comprise employing at least one slanted guide at an end of the second connector for positioning the connectors.

Preferably, the leg is inserted into an insertion groove that extends from the loose hole to an outer edge of the supporting plate in a direction substantially parallel with a surface of the supporting plate.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
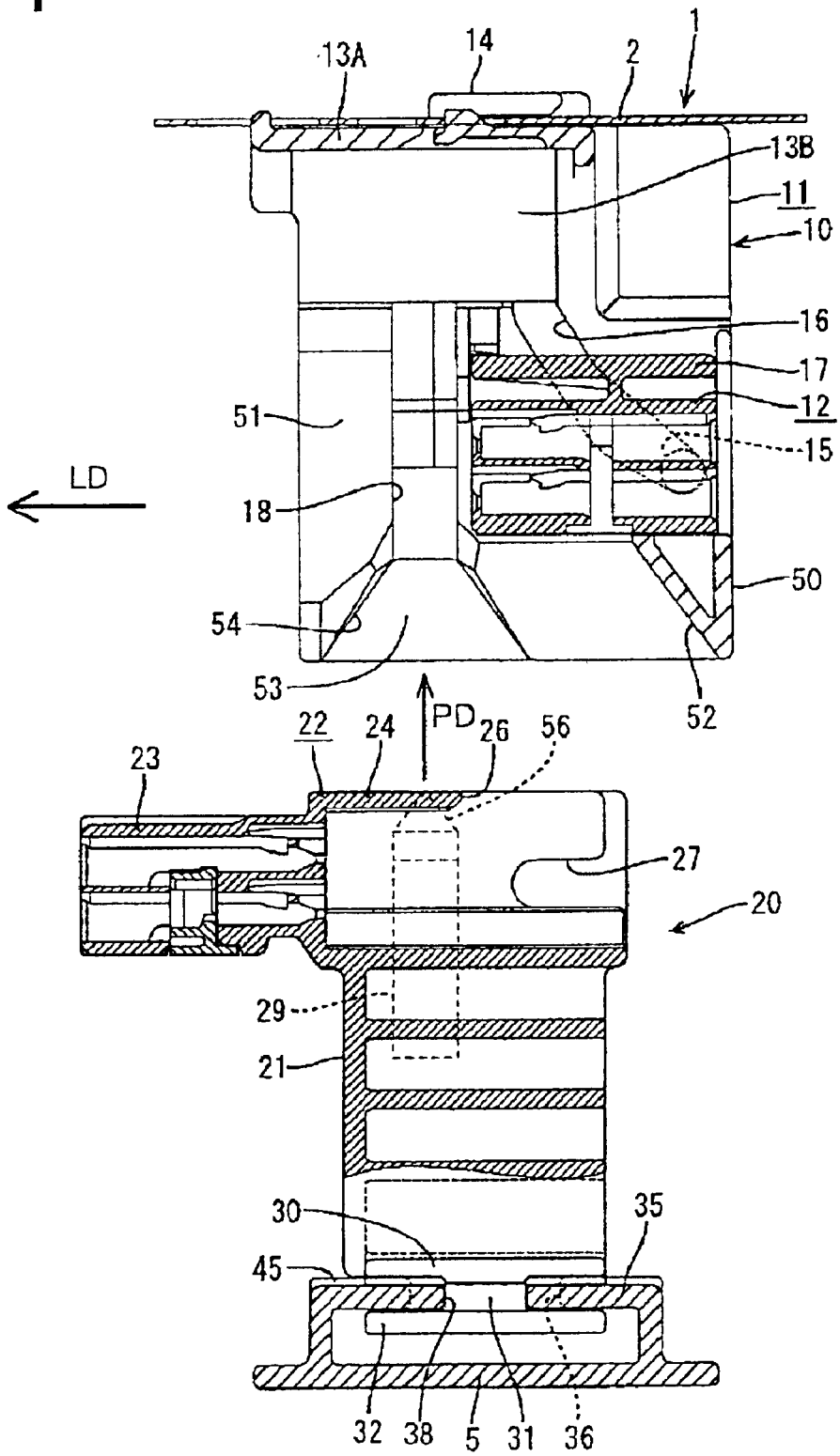
FIG. 1 is a vertical section of male and female connectors according to one embodiment of the invention before being connected.

A connector connecting construction according to an embodiment of the invention is illustrated in FIGS. 1 to 12, and relates to a map light to be provided at the ceiling of a passenger compartment of an automotive vehicle. As shown in FIG. 1, a female connector 10 is provided on a body panel 1 on the ceiling, whereas a movable male connector 20 is to be provided on a trim panel 5. The male connector 20 is connected with the female connector 10 as the trim panel 5 is lined up to the body panel 1.

The female connector 10 has a female housing 12 aligned substantially parallel to the body panel 1 and accommodated in a holder 11. The holder 11 has and upper plate 13A and left and right side plates 13A that hang down from the upper plate 13A. A socket is fixed to the upper plate 13A and is fixed to a bracket 2 on the body panel 1.

The female housing 12 accommodates female terminal fittings (not shown) for connection with a wiring harness connected with the map light or the like and initially is at a rear (right in FIG. 1) bottom side in the holder 11. Cam pins 15 project on the left and right side surfaces of the female housing 12 and engage with corresponding cam grooves 16 in the left and right side plates 13B of the holder 11. The cam pins 15 and the cam grooves 16 function to move the female housing 12 forward as the female housing 12 is moved up.

A pushable plate 17 is provided unitarily on the upper surface of the female housing 12. Guide grooves 18 are formed in the left and right side plates 13B of the holder 11 and extend substantially along the pushing direction of the male connector 20.

The male connector 20 has a base 21 and a male housing 22 is formed unitarily on the upper surface of the base 21. The male housing 22 has a terminal-accommodating portion 23 and a receptacle 24 for receiving the female housing 11 extends from the front surface of the terminal-accommodating portion 23. The male housing 22 will extend substantially parallel to the body panel 1.

Male terminal fittings (not shown) are accommodated in the terminal-accommodating portion 23 of the male housing 22 so that tabs of the male terminal fittings project into the receptacle 24. The male terminal fittings are part a wiring harness, which in turn is connected with a power supply.

A window 26 is formed at the front side of the upper surface of the receptacle 24 for permitting insertion of the female housing 12 from above, and an escaping groove 27 for the cam pin 15 is formed in each of the left and right lateral surfaces of the receptacle 24. Guide ribs 29 extend from the upper part of the base 21 over the left and right lateral surfaces of the receptacle 24 and are insertable into the corresponding guide grooves 18 of the holder 11.

Figure 11:
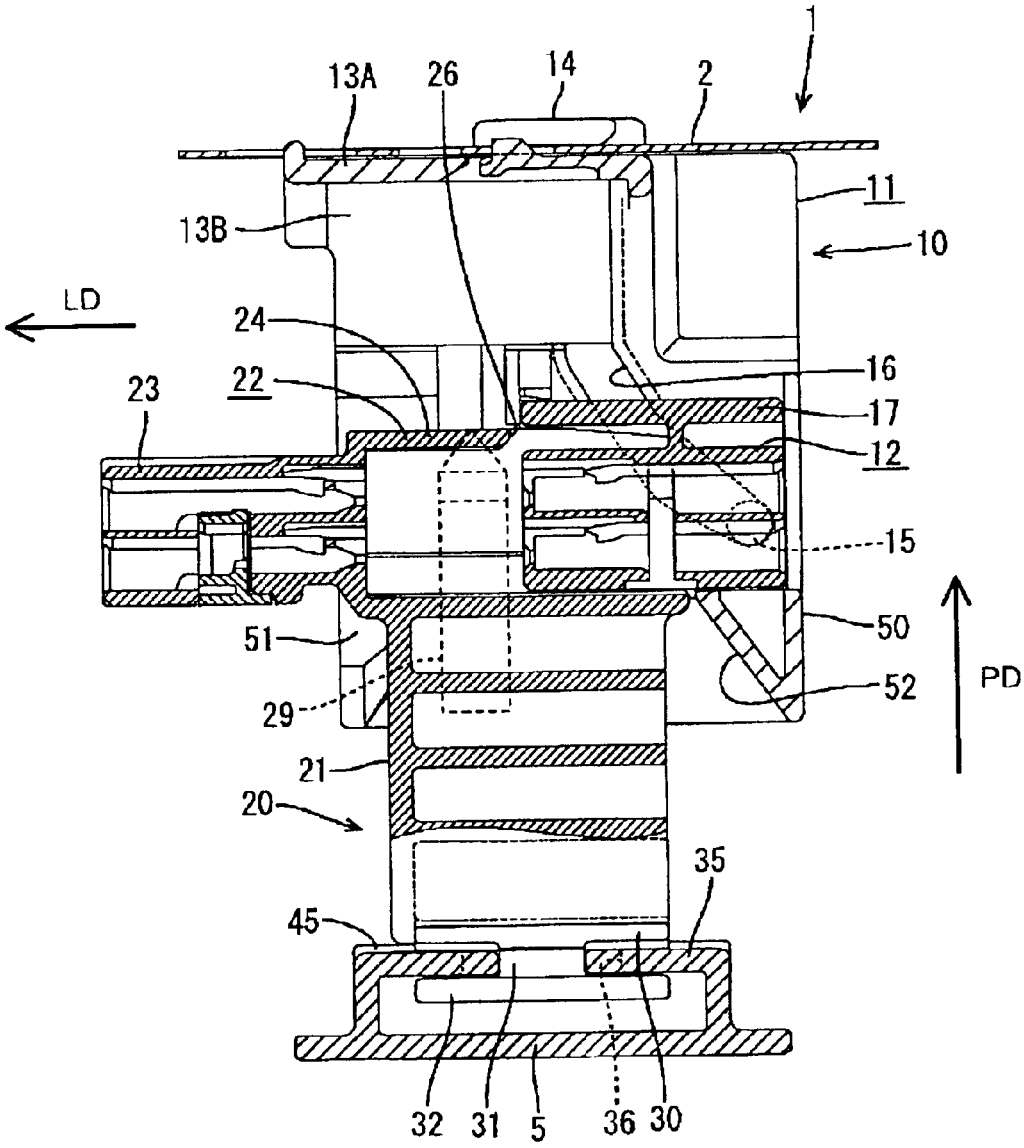
FIG. 11 is a vertical section showing a state where the female housing is introduced into a receptacle of the male housing.
Figure 12:
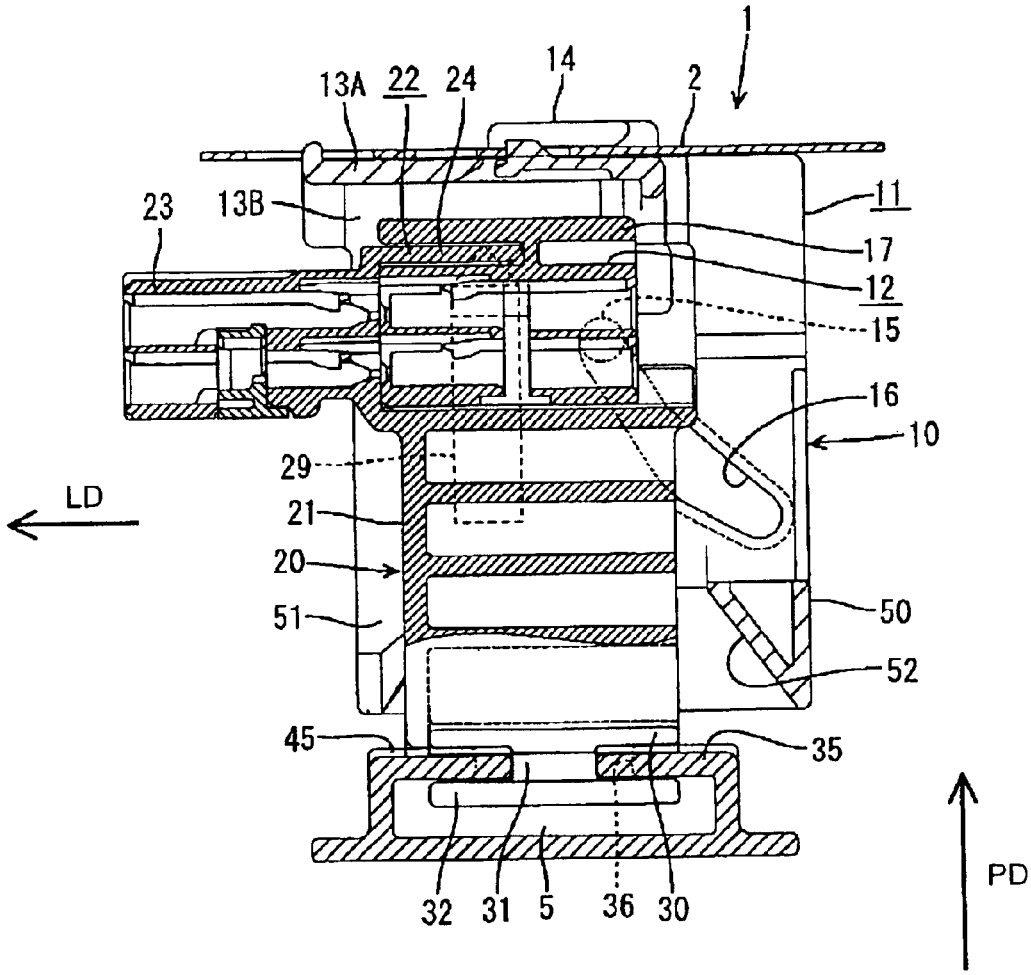
FIG. 12 is a vertical section showing a state where the male and female housings are properly connected with each other.

The front part of the female housing 12 is inserted into the receptacle 24 of the male housing 22 through the window 26 when the guide ribs 29 align with the corresponding guide grooves 18, as shown in FIG. 11. The male connector 20 then is pushed up in the pushing direction PD into the female connector 10, as indicated by an arrow in FIG. 1. The male connector 20 is pushed further in the pushing direction PD and the upper surface of the base 21 pushes the pushable plate 17, thereby pushing the female housing 12 up in the pushing direction PD. Simultaneously, the female housing 12 is guided forward in a lateral direction LD by the cam pins 15 and the cam grooves 16. The lateral direction LD is at an angle, and preferably substantially normal to the pushing direction PD. Consequently, the female housing 12 is fit to the back end of the receptacle 24 of the male housing 22 as shown in FIG. 12.

Figure 2:
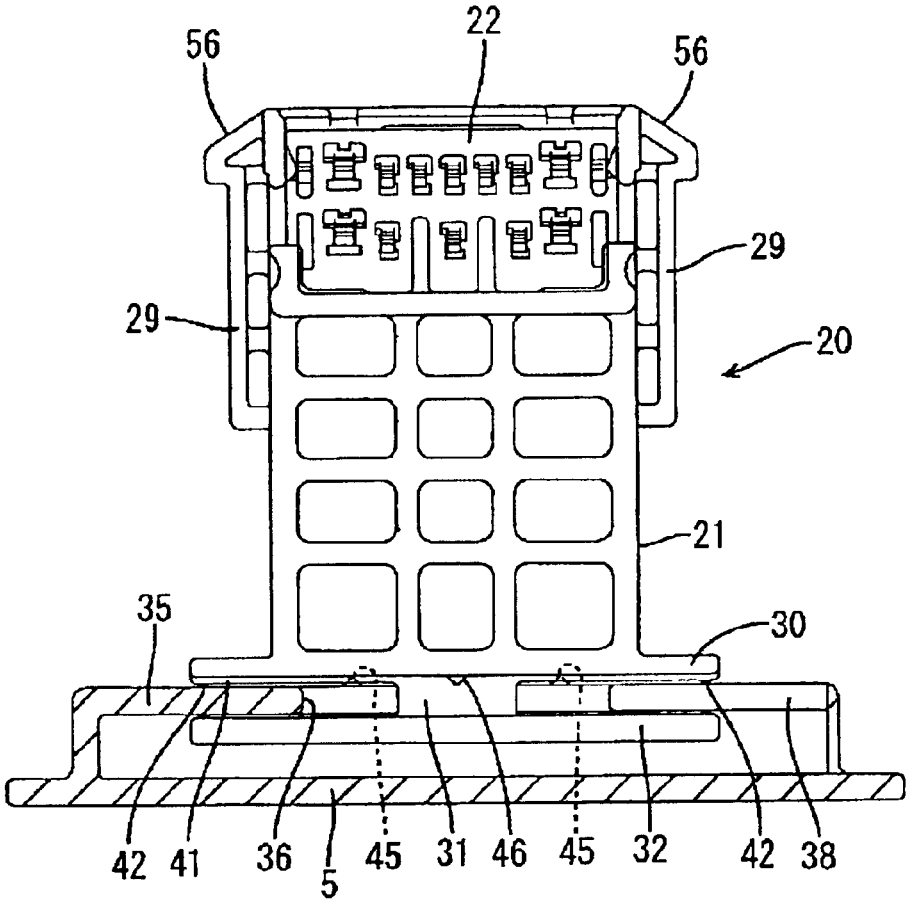
FIG. 2 is a section showing a supporting construction for the male connector when viewed from front.
Figure 3:
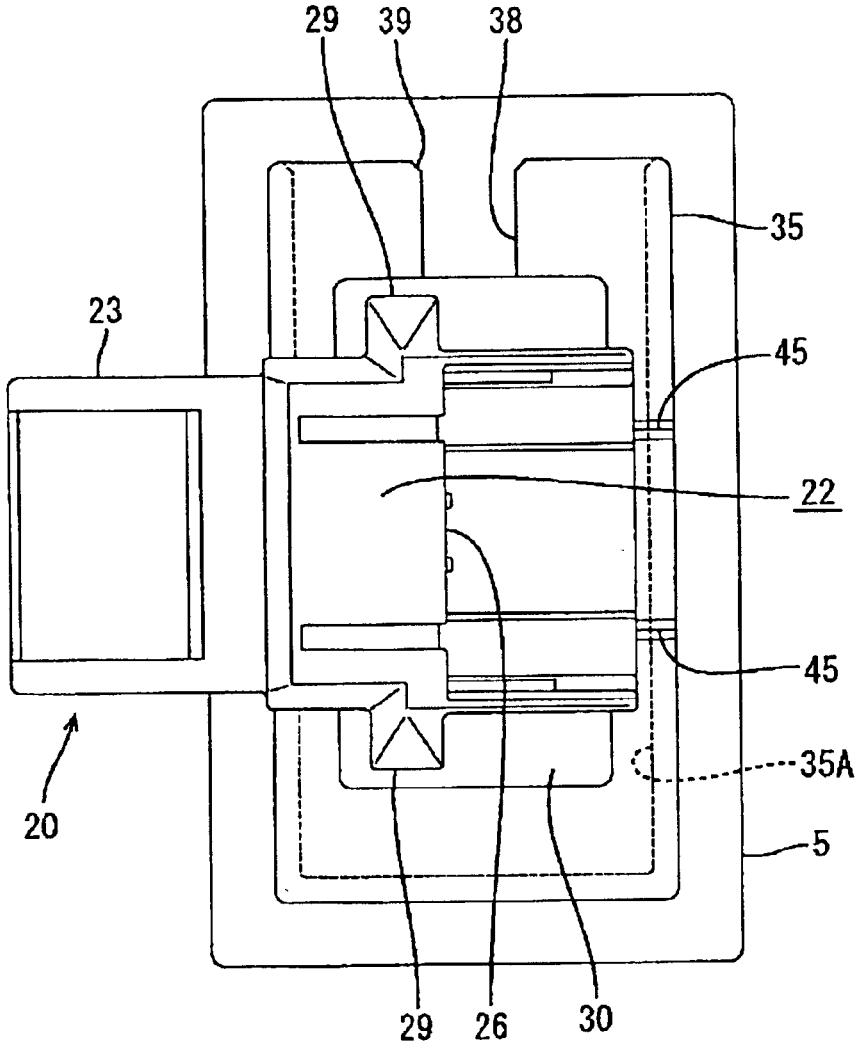
FIG. 3 is a plan view of the supporting construction of FIG. 2.
Figure 4:
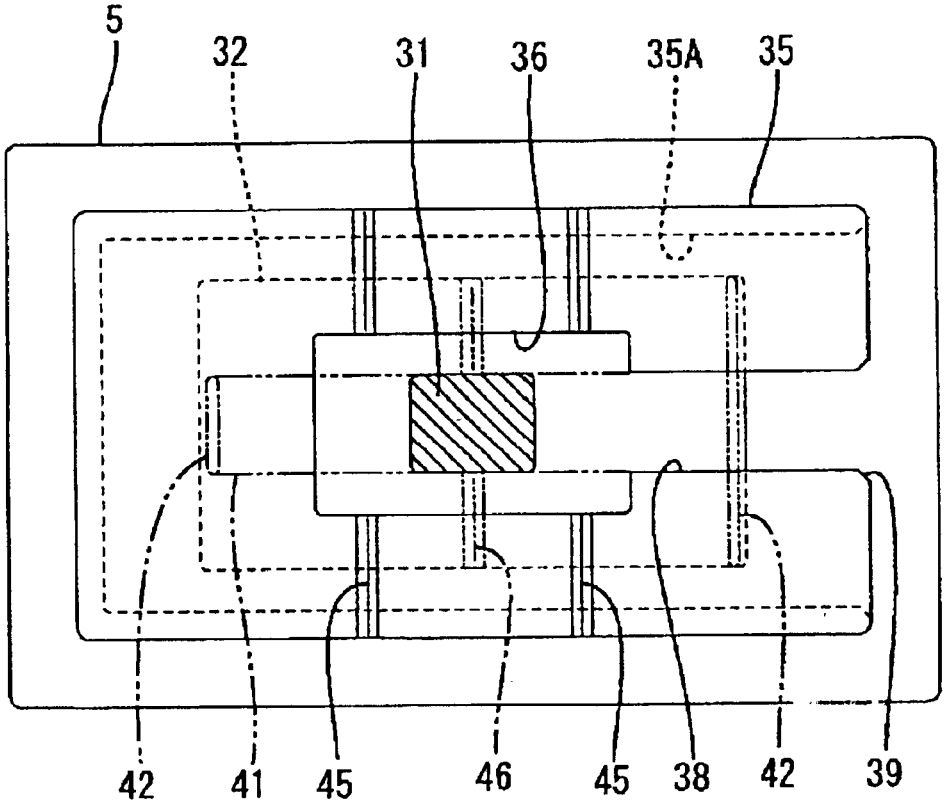
FIG. 4 is a plan view in section of the supporting construction of FIG. 2.
Figure 5:
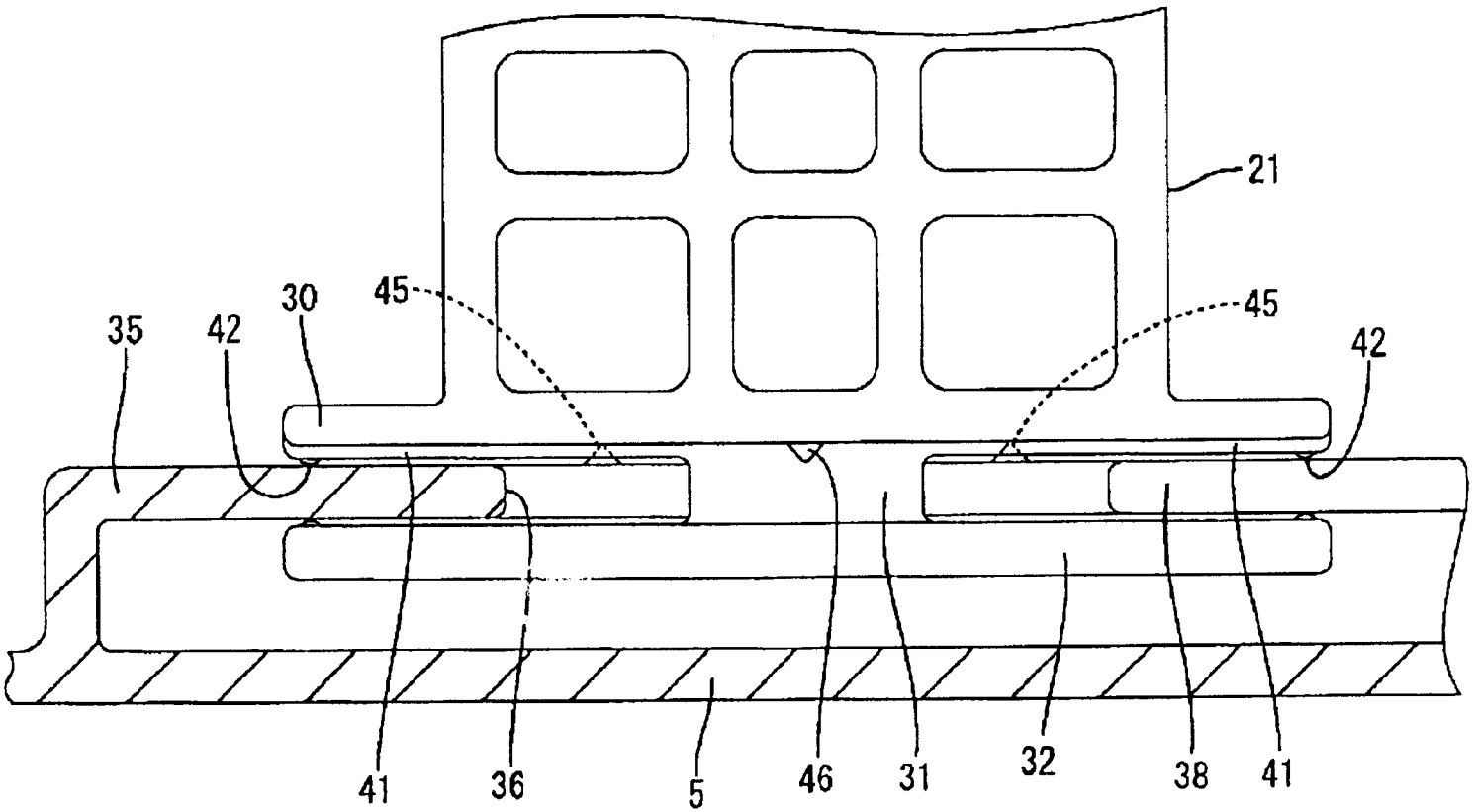
FIG. 5 is a fragmentary enlarged front view partly in section of the supporting construction of FIG. 2.

A substantially rectangular contact plate 30 is formed unitarily at the bottom surface of the base 21 and bulges out from the front and rear surfaces of the base 21 by a specified distance, as shown in FIGS. 2 and 3. A short leg 31 projects in the center of the bottom surface of the contact plate 30, as shown in FIG. 4. The leg 31 is of substantially rectangular cross section and is slightly longer along the transverse direction. A fastening plate 32 of substantially the same outer shape as the contact plate 30 is formed at the projecting end of the leg 31 and is substantially parallel with the contact plate 30.

A supporting plate 35 is raised from the outer surface of the trim panel 5. The supporting plate 35 is of substantially rectangular plan view and is slightly larger than the contact plate 30 and the fastening plate 32. Thus, the supporting plate 35 is substantially in the form of a saucer turned upside down, and an opening is made in one shorter surface (right surface in FIG. 4).

A substantially rectangular loose hole 36 is formed in the center of the supporting plate 35 and the leg 31 of the female connector 10 is insertable through the loose hole 36 with a clearance. The longer sides of the loose hole 36 are slightly over 2.5 times the longer cross-sectional dimension of the leg 31, and the shorter sides are slightly below twice the shorter cross-sectional dimension of the leg 31. Accordingly, the supporting plate 35 can be arranged tightly between the fastening plate 32 and the male connector 20 while allowing a relative displacement between the male connector 20 and the support plate 35 along directions parallel to the plane of the supporting plate 35 and normal to the pushing direction PD.

An insertion groove 38 is formed substantially in the widthwise center of the opened shorter side of the supporting plate 35 (FIGS. 4 and 6) and reaches the loose hole 36. This insertion groove 38 has a width substantially equal to the shorter cross-sectional dimension of the leg 31, but has a widened flared entrance 39.

A strip-shaped projection 41 (shown by chain line in FIG. 4) projects slightly from the lower surface of the contact plate 30 of the male connector 20. The strip-shaped projection 41 has a width equal to the shorter cross-sectional dimension of the leg 31 and connects the centers of the shorter sides of the contact plate 30 to the leg 31. A shake-preventing rib 42 is formed only at an end of the strip-shaped projection 41 at the closed shorter side of the lower surface of the contact plate 30. On the other hand, a shake-preventing rib 42 is formed over substantially the entire length of the opposite opened shorter side.

The leg 31 of the male connector 20 is introduced through the insertion groove 38 and is guided by the strip-shaped projection 41 into the loose hole 36 while moving along the surface of the supporting plate 35. Consequently the supporting plate 35 is held tightly between the two shake-preventing ribs 42 of the contact plate 30 and the fastening plate 32 so as not to shake.

Two spaced apart restricting ribs 45 are formed on the outer surface of the supporting plate 35 at opposite sides of the centers of longer sides of the loose hole 36 and extend at an angle, and preferably a right angle, to the longer sides of the supporting plate 35. The restricting ribs 45 each have a height substantially equal to the heights of the shake-preventing ribs 42.

A contact rib 46 is formed substantially at the longitudinal center of the lower surface of the contact plate 30 of the male connector 20 and aligns with the leg 31. The height of the contact rib 46 substantially equals the heights of the shake-preventing ribs 42.

The leg 31 is inserted through the insertion groove 38 of the supporting plate 35 into the loose hole 36 while the contact rib 46 moves over the right restricting ribs 45 in FIG. 4.

A spacing between the restricting ribs 45 is set such that the contact rib 46 contacts the left or right lateral restricting ribs 45 when the leg 31 is moved laterally to the left or right in the state shown in FIG. 4 to contact the left or right shorter side of the loose hole 36.

The restricting ribs 45 cooperate with the shake-preventing ribs 42 to hold the supporting plate 35 tightly between the contact plate 30 and the fastening plate 32 so as not to shake. Further, the right restricting rib 45 in FIG. 4 is brought into contact with the contact rib 46 to prevent the leg 31 from coming out through the insertion groove 38.

Figure 6:
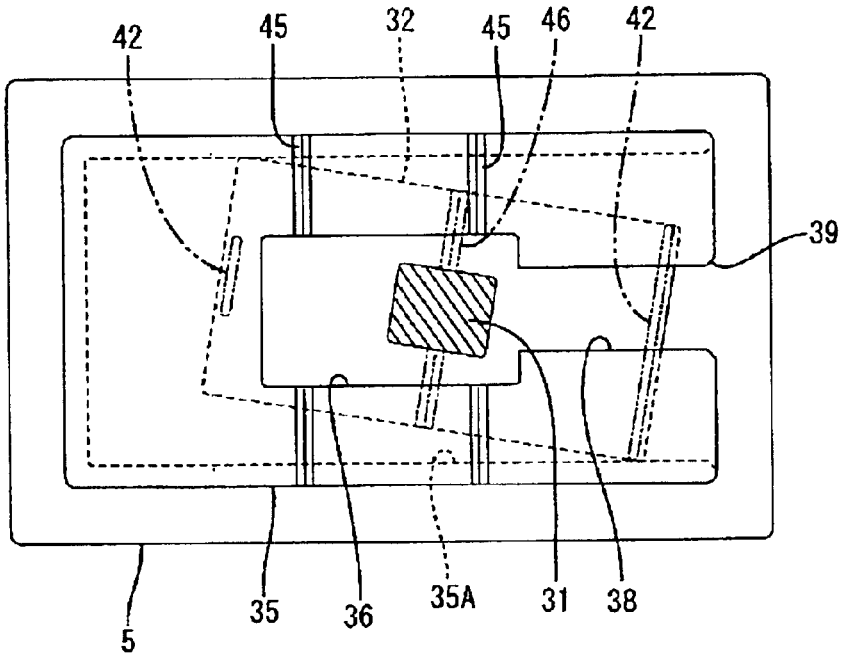
FIG. 6 is a plan view in section showing a state where a displacement of the male connector is restricted.

The male connector 20 can be rotated about the longitudinal axis extending through the leg 31 and hence can be rotated clockwise in the loose hole 36 in the plane of FIG. 6. However, the rotation is restricted by the contact of the lower-right and upper-left corners of the fastening plate 32 in FIG. 6 with a surrounding wall 35A of the supporting plate 35. The leg 31 could moved further from the position of FIG. 6 until contacting the right shorter side. However, such a further rotation is prevented by the contact of the contact rib 46 with the right restricting rib 45. The same applies to the leftward or counterclockwise rotation. Thus, the ribs 45, 46 function to prevent the male connector 20 from being rotated laterally to left and right more than necessary when the male connector 20 is displaced rotationally.

Figure 7:
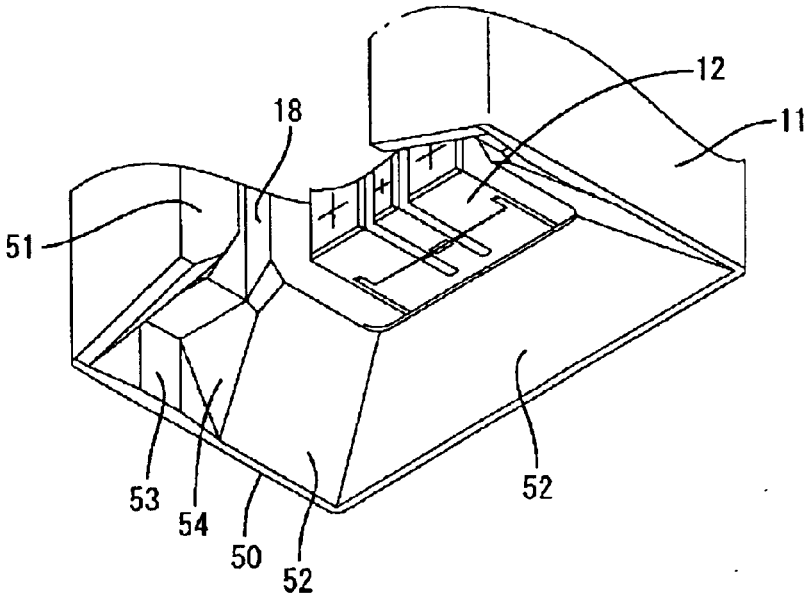
FIG. 7 is a fragmentary perspective view of the female connector when viewed from below.

A receptacle 50 is provided at the bottom or mating side of the holder 11 of the female connector 10 as shown in FIGS. 1 and 7 for guiding the mating male connector 20. Specifically, the receptacle 50 has rear, left and right surfaces, and an opening 51 for causing the male housing 22 to escape is formed in the front surface thereof. The receptacle 50 includes slanted inner surfaces 52 that gradually narrow in the pushing direction PD, as shown in FIGS. 1 and 7.

The slanted surfaces 52 are cut substantially at right angles to define grooves 53 that extend out at the positions corresponding to the entrances of the vertical guide grooves 18. Opposite side surfaces of the grooves 53 define auxiliary slanted surfaces 54 that are narrowed in the pushing direction PD.

Each guide rib 29 of the male connector 20 is formed with a pointed guiding head 56 at its upper end, as shown in FIGS. 1 and 2.

The female housing 12 is substantially parallel to the plane of the body panel 1 at the rear bottom position of the holder 11 in the female connector 10, and the socket 14 is inserted into the bracket 2 in this state. Thus, the female connector 10 is mounted at the specified position on the body panel 1 while facing towards the male connector 20 and away from the body panel 1.

The leg 31 of the male connector 20 is inserted sideways through the insertion groove 38 and into the loose hole 36 of the supporting plate 35. The leg 31 can move in the loose hole 36 due to the clearance. Thus, the male connector 20 can move relative to the supporting plate 35 of the trim panel 5 and substantially parallel to the plane of the body panel 1.

Figure 8:
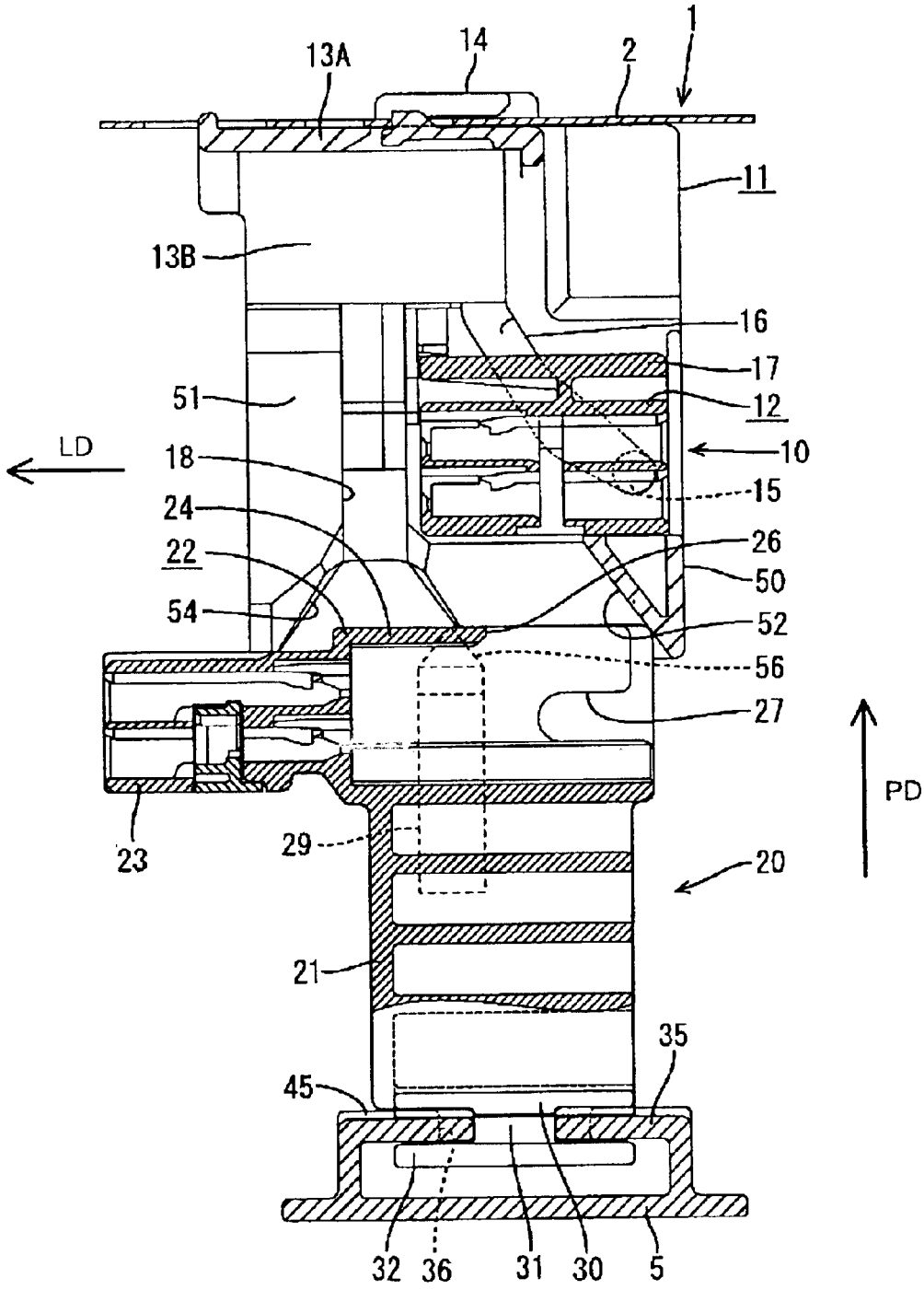
FIG. 8 is a vertical section showing an operation of correcting a displacement of the centers of the male and female connectors.
Figure 9:
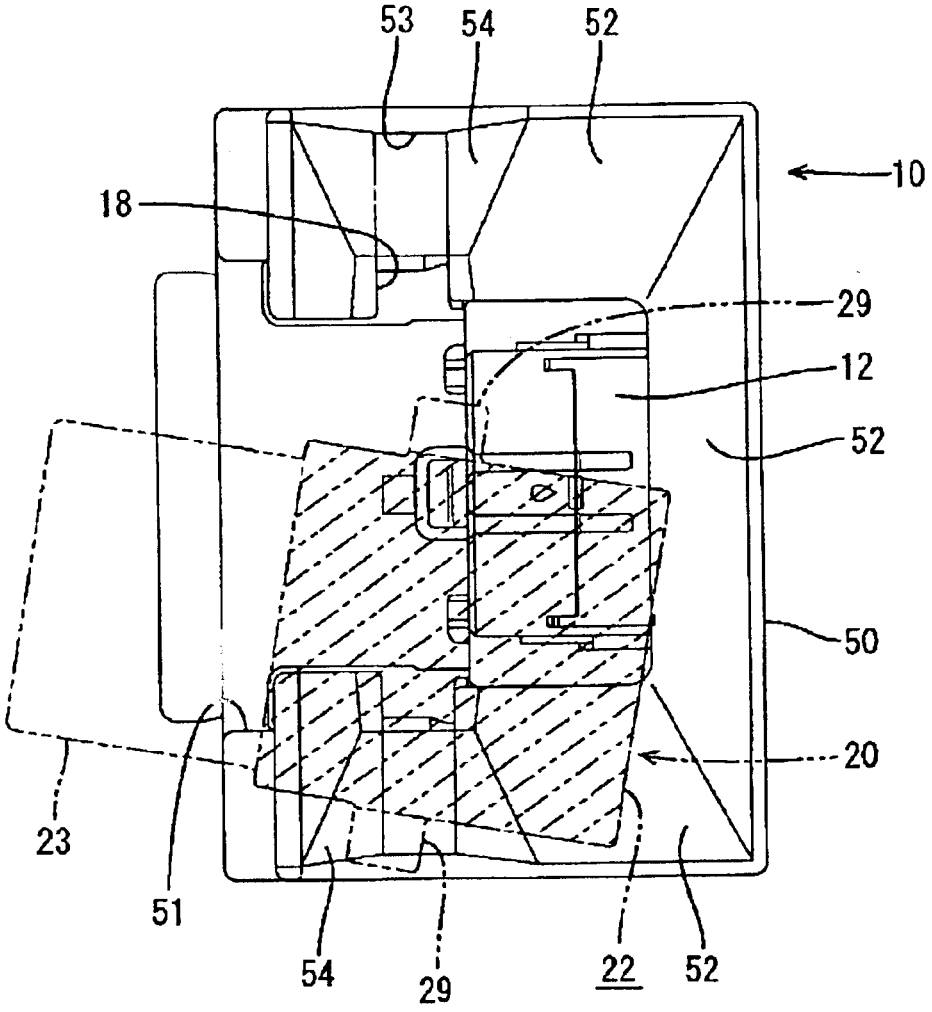
FIG. 9 is a bottom view of the female connector showing an operation of correcting a rotational displacement.
Figure 10:
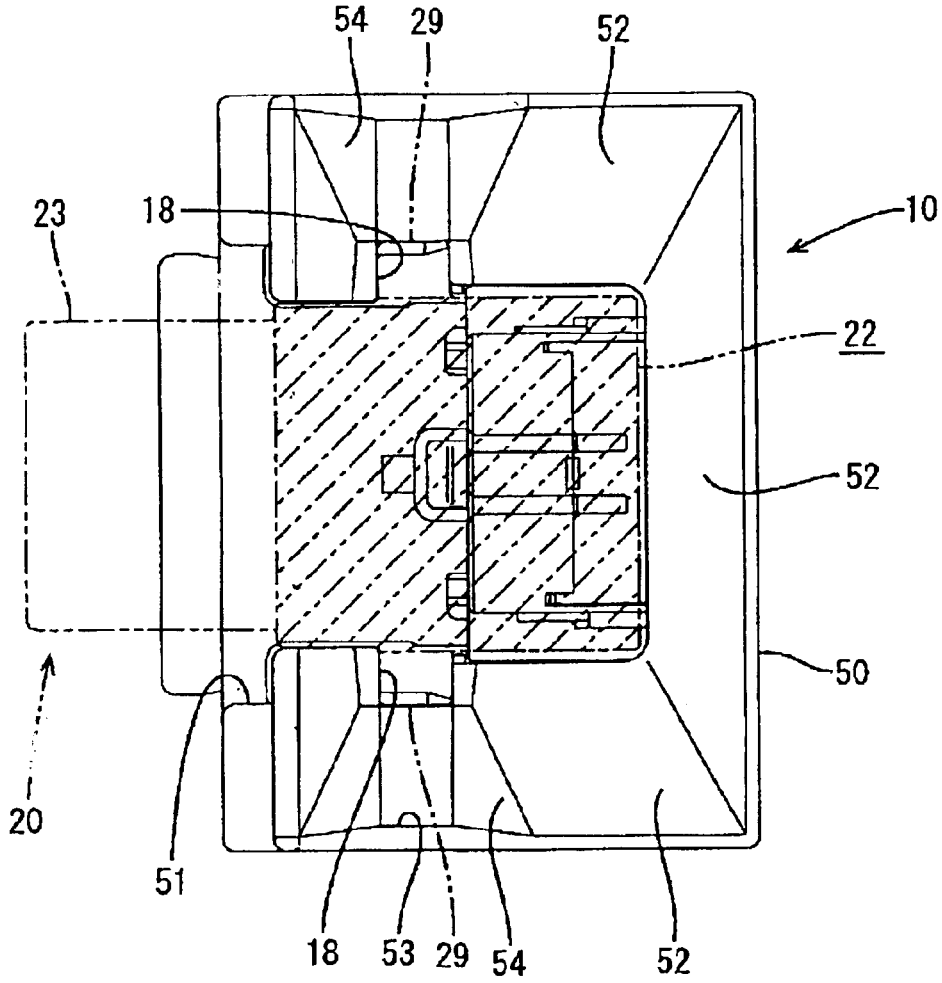
FIG. 10 is a bottom view of the female connector showing a state where positioning is completed.

The trim panel 5 is lined up with the lower surface of the body panel 1 and the male connector 20 is connected with the mating female connector 10 as indicated by the arrow of FIG. 1. At this time, the male connector 20 may be displaced to the front, back, left or right or rotationally displaced on the horizontal plane with respect to the female connector 10. In such a case, corners of the upper surface of the male housing 22 contact the slanted surfaces 52 of the receptacle 50 in the holder 11 of the female connector 10 as shown in FIGS. 8 and 9. Thus, the male connector 20 has its center substantially aligned with that of the female connector 10 and the rotational displacement is guided by the slanted surfaces 52 and substantially corrected while the leg 31 is moved within the loose hole 36 of the supporting plate 35. Further, the guiding heads 56 are guided by the auxiliary slanted surfaces 54 to introduce the guide ribs 29 into the guide grooves 18, as shown in FIG. 10.

The trim panel 5 is lifted further so that the front side of the female housing 12 is inserted into the receptacle 24 of the male housing 22 through the window 26, as shown in FIG. 11. Subsequently, the upper surface of the base 21 pushes the pushable plate 17, thereby pushing the female housing 12 up, and simultaneously the cam pins 15 and cam grooves 16 guide the female housing 12 forward in the lateral direction LD to the back end of the male housing 22 as shown in FIG. 12. The female and male housings 12, 22 are held properly connected and the trim panel 5 finally is fixed to the body panel 1.

As described above, displacement of the male connector 20 from the mating female connector 10 can be taken up within a range where the leg 31 of the male connector 20 is movable within the loose hole 36 of the supporting plate 35. This movement takes advantage of the clearance between the leg 31 and the loose hole 36, and there is no particular limit in the dimension of the clearance. Thus, displacement can be taken up over a wide range. Further, unlike the prior art that utilizes a spring piece to take up the displacement, a smaller force is required to connect the connectors 10, 20 since no returning resilient force is exerted during positioning.

The contact rib 46 on the contact plate 30 of the male connector 20 is located between the preventing ribs 45 on the supporting plate 35 and contacts the preventing ribs 45 to restrict angular rotation of the male connector 20. This simple construction prevents angular movement of the male connector 20 from becoming unnecessarily large, and as a result, the size of the receptacle 50 of the female connector 10 can be minimized.

The invention is not limited to the above described and illustrated embodiment. For example, the following embodiments are also embraced by the technical scope of the present invention as defined by the claims. Beside the following embodiments, various changes can be made without departing from the scope and spirit of the invention as defined by the claims.

Converse to the foregoing embodiment, the connector on the body panel may move loosely and the connector on the trim panel may be fixed.

Converse to the foregoing embodiment, the preventing ribs and the contact rib to be located between them may be provided on the contact plate of the male connector and on the supporting plate, respectively.

The male and female housings are connected horizontally and substantially normal to directions in which the body and trim panels face each other in the foregoing embodiment. However, the invention is also applicable to connectors where male and female housings are connected in vertical direction parallel with the facing directions of the body panel and the trim panel.

The invention is generally widely applicable to connectors provided, for example, on a fixed plate and a movable plate of an automotive vehicle and connectable with each other as the movable plate is mounted on the fixed plate.

What is claimed is:

1. A connector connecting construction for achieving electrical connection between first and second connectors while mounting a first member and a second member, the first connector being mounted to the first member, the construction comprising:

a supporting plate supported in spaced relationship to the second member, the supporting plate having a plurality of outer edges and opposed first and second surfaces and being formed with a hole extending between the surfaces and spaced from the outer edges, an insertion groove extending between the surfaces and further extending from the hole to one of said outer edges of the supporting plate, the groove defining a width that is less than cross sectional dimensions of the hole as measured in direction parallel to the first and second surfaces, the second connector being slidably disposed substantially adjacent the first surface of the supporting plate;

a leg extending rigidly from the second connector and being dimensioned for slidable insertion through said groove, the leg passing through the hole of the supporting plate, the leg having a leading end and being dimensioned to define a clearance with respect to the hole so that the second connector can translate and rotate in sliding relationship to the first surface of the supporting plate within limits defined by the dimensions of the leg and the hole of the supporting plate; and a fastening portion at the leading end of the leg and slidably disposed substantially adjacent the second surface of the supporting plate, the fasting portion having cross sectional dimensions greater than the width of the groove and greater than the cross sectional dimensions of the hole in the supporting plate.

2. The construction of claim 1, wherein shake-preventing ribs are on at least one of the surfaces of the supporting plate and engage at least one of the second connector and the fastening portion.

3. The construction of claim 1, wherein the leg is the only structure extending from the second connector and through the supporting plate.

4. The construction of claim 1, further comprising two spaced apart restricting ribs on at least one of the surfaces of the supporting plate, and a contact rib on at least one of the second connector and the fastening portion, the contact rib being disposed between the restricting ribs.

5. The construction of claim 1, wherein at least one guiding slanted portion is provided at an engaging end of the first connector with the second connector for positioning the connectors.

6. The construction of claim 5, wherein the first connector has at least one guide groove and the second connector has at least one guide rib (29) to be introduced into the guide groove.

7. The construction of claim 1, wherein the hole is substantially rectangular, the groove defining a width less than a length and width of the rectangular hole.

8. The construction of claim 7, wherein the leg has a substantially rectangular cross section with a width less than the width of the groove.

9. A connector connecting construction for achieving electrical connector between first and second connectors while mounting a first member and a second member, the first connector being mounted to the first member, the construction comprising:

a supporting plate supported in spaced relationship to the second member, the supporting plate having opposed first and second surfaces and being formed with a hole extending between the surfaces, an insertion groove extending from the hole to an outer edge of the supporting plate, the second connector being slidably disposed substantially adjacent the first surface of the supporting plate;

a leg extending rigidly from the second connector and through the hole of the supporting plate, the lea having a leading end and dimensioned for insertion through the insertion groove in a direction substantially parallel with the surfaces of the supporting plate and to define a clearance with respect to the hole;

a fastening portion at the leading end of the leg and slidably disposed substantially adjacent the second surface of the supporting plate; and a projection on a surface of the second connector facing the fastening portion for guiding the insertion of the leg into the insertion groove.

10. The construction of claim 9, further comprising two spaced apart restricting ribs on at least one of the surfaces of the supporting plate, and a contact rib on at least one of the second connector and the fastening portion, the contact rib being disposed between the restricting ribs.

11. A connector assembly for achieving electrical connection while mounting a first member and a second member together, the connector assembly, comprising:

a first connector mounted to the first member;

a second connector for connection to the first connector;

a supporting plate supported in spaced relationship to the second member, the supporting plate having opposed first and second surfaces and a plurality of outer edges, a loose hole extending between the surfaces and spaced from the outer edges, a groove extending between the first and second surfaces and extending from the loose hole to one of said outer edges, the groove having a width less than cross sectional dimensions of the loose hole, the second connector being slidably disposed substantially adjacent the first surface of the supporting plate;

a leg extending rigidly from the second connector and being inserted through the groove and disposed in the loose hole of the supporting plate, the leg having a leading end and being dimensioned to define a clearance with respect to the loose hole such that the second connector can translate and rotate in sliding relationship on the first surface of the supporting plate; and a fastening portion at the leading end of the leg and being slidably disposed substantially adjacent the second surface of the supporting plate, the fasting portion having cross sectional dimensions greater than the cross sectional dimensions of the loose hole.

12. The connector of claim 11, wherein at least one guiding slanted portion is provided at an engaging end of the first connector with the second connector for positioning the connectors.

13. The connector of claim 12, wherein the first connector has at least one guide groove and the second connector has at least one guide rib to be introduced into the guide groove on the first connector.

* * * * *